United States Patent [19]

Christoffel, Jr. et al.

[11] Patent Number: 4,457,478

[45] Date of Patent: Jul. 3, 1984

[54] KEEL GUIDED ACROBATIC KITE AND CONTROL APPARATUS THEREFOR

[75] Inventors: Julius M. Christoffel, Jr.; George Peneer, both of Houston, Tex.

[73] Assignee: Gayla Industries, Inc., Houston, Tex.

[21] Appl. No.: 407,338

[22] Filed: Aug. 12, 1982

[51] Int. Cl.[3] ..... B64C 31/06

[52] U.S. Cl. ..... 244/155 A

[58] Field of Search ..... 244/153 R, 154, 155 R, 244/155 A; D21/88

[56] References Cited

U.S. PATENT DOCUMENTS

| | | | |
|---|---|---|---|
| 2,696,960 | 12/1954 | Howard | 244/153 R |
| 2,785,870 | 3/1957 | Green | 244/153 R |
| 2,839,259 | 6/1958 | Mayne | 244/155 A |
| 3,421,722 | 1/1969 | May et al. | 244/155 A |
| 3,687,402 | 8/1972 | Christoffel et al. . | |
| 3,746,286 | 7/1973 | Christoffel . | |
| 4,026,504 | 5/1977 | Christoffel, Jr. . | |

OTHER PUBLICATIONS

Pelham, "Kites", Penguin Books, pp. 135–136, 1976.

*Primary Examiner*—Galen L. Barefoot

*Attorney, Agent, or Firm*—Arnold, White & Durkee

[57] ABSTRACT

A keel guided acrobatic kite and control apparatus are disclosed in which a reference point included on the keel of the kite is maintained no more than a fixed maximum distance from reference locations included on the body of the kite. Stabilizer lines are secured between the reference location on the keel and each of the reference locations on the body. When the kite is in a nominal flying position, the keel is disposed essentially perpendicular to the body of the kite, and the stabilizer lines are taut. Two control lines are received by guidance structure connected to the reference location of the keel. One end of each control line is secured to one of the reference points on the body. In operation, one of the control lines is pulled, causing the reference point on the keel to move toward one of the reference points included on the body. The stabilizer line connected to that reference point slackens while the other stabilizer line remains taut. The keel forms a pocket extending toward the taut stabilizer line, changing the aerodynamic properties of the kite, and causing the kite to turn.

14 Claims, 3 Drawing Figures

KEEL GUIDED ACROBATIC KITE AND CONTROL APPARATUS THEREFOR

BACKGROUND OF THE INVENTION

This invention relates generally to keel kites. More particularly, the present invention relates to keel guided acrobatic kites and apparatus to control the maneuvering of such kites from the ground.

Keel guided kites are well-known to the art. U.S. Pat. No. 3,687,402, assigned to the assignee of the present application, discloses a keel guided kite having a body, rigidifying structural members and a keel. The keel is basically triangular in shape and is attached along its longest edge to the body. The keel includes an eyelet or other structure to which is attached a control line. The kite is guided and controlled by the single control line attached to the keel. During flight, the kite is maneuvered from the ground by manipulating the single control line.

U.S. Pat. No. 3,746,286, assigned to the assignee of the present application, discloses another keel guided kite having a body, rigidifying structural members and a keel. The disclosed kite further includes structure which permits the relative relationship between the keel and the body to be controlled from the ground. During flight, the structure provides a degree of control over maneuvering the kite.

The structure includes a control rod attached at its center to the keel. One end of the control rod is secured by a fixed length line to the rigidifying structure on one side of the kite. The other end of the control rod is secured by another fixed length line to the rigidifying structure on the other side of the kite. To maneuver the kite from the ground, the user manipulates control lines secured to each end of the control rod.

In manipulating the control lines, the user essentially causes the control rod to pivot about the control rod center secured to the keel. The relative position of the keel with respect to the body is changed, causing the kite to move. The user can perform various stunts by manipulating the control lines, thereby extending his kite flying enjoyment.

The various stunts that can be performed with known prior art kites is limited. Thus, there is a need for both a keel guided kite and for control apparatus for use on existing keel guided kites which permit the kite user a greater degree of control and maneuverability.

SUMMARY OF THE INVENTION

According to the present invention, apparatus is provided to vastly increase the maneuverability of known prior art keel guided kites. Specifically, the present invention provides a keel guided kite having a body and a keel secured to the body. The keel extends generally fore and aft of the body, and divides the body into two wing portions.

Two stabilizer lines are included. Each stabilizer line has an end secured to the keel and another end secured to a line connect location on one wing portion.

Two control lines are also provided. Each control line includes an end secured to one of the wing portions at the line connect location.

The control lines are also received and guided by control line guidance structure included on the keel. The control line guidance structure permits one or both of the control lines to be manipulated from the ground to cause the keel to be moved closer to one wing portion or the other. The maximum separation between the keel and each wing portion is established by the stabilizer lines.

In operation, when the kite is airborne, the keel assumes a nominal orientation with respect to the body in which both stabilizer lines are taut. The keel is disposed generally perpendicular to the body of the kite. The point on the keel at which the stabilizer lines are secured is separated from the line connect location on each wing portion by a fixed maximum amount equal to the length of the stabilizer line.

To manipulate movement of the kite, the user pulls one of the control lines. This causes the separation between the keel and the line connect location at which the manipulated control line is attached to decrease below the maximum value set by the stabilizer line. The separation between the keel and the line connect location on the other wing portion remains fixed at the maximum value established by the stabilizer line. So manipulated, the aerodynamics of the keel is altered causing the kite to change direction. Specifically, a pocket is formed on the side of the kite at which the manipulated control line is attached, creating an airfoil which causes the kite to roll.

BRIEF DESCRIPTION OF THE DRAWINGS

The invention will further be described with reference to the accompanying drawings which illustrate particular embodiments of a keel guided acrobatic kite and control apparatus in accordance with the present invention, wherein like members bear like reference numerals and wherein.

DESCRIPTION OF THE PREFERRED EMBODIMENTS

Figure 1:
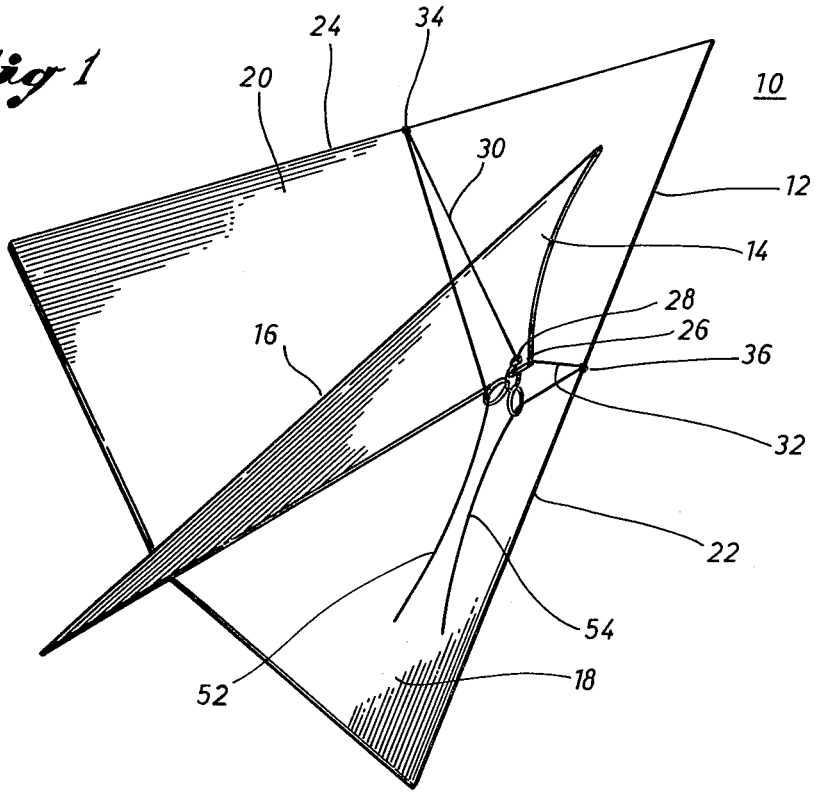
FIG. 1 is a perspective view of a keel guided kite and control apparatus according to the present invention.

Referring now to the drawings, and in particular to FIG. 1, there is shown in perspective view of keel guided kite 10 having a body 12 and a keel 14.

The keel 14 has a generally triangular configuration, and includes an edge 16 secured to the body 12 of the kite 10. The keel 14 extends generally fore and aft of the body 12 and divides the body into wing portions 18 and 20. The wing portions 18 and 20 include leading edges 22 and 24, respectively.

The keel 14 further includes an angular corner 26 disposed opposite the edge 16. The angular corner 26 includes an eyelet 28, best illustrated in FIG. 3.

Figure 3:
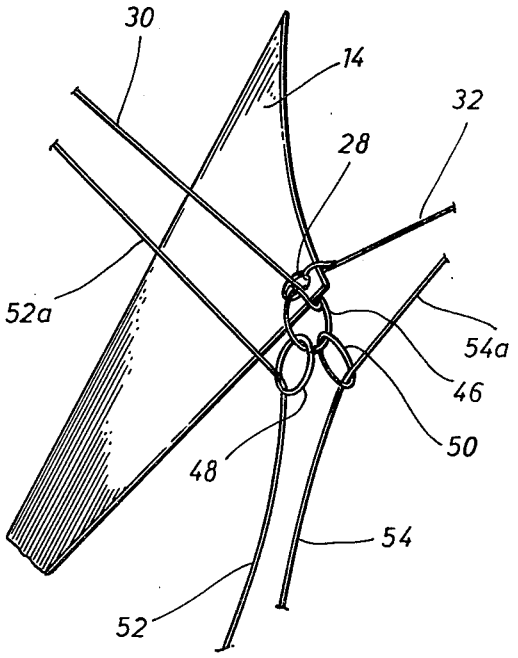
FIG. 3 is an enlarged perspective view of the keel and the control apparatus illustrated in FIGS. 1 and 2.

Referring to FIGS. 1 and 3, the kite 10 further includes stabilizer lines 30 and 32. One end of the stabilizer line 30 is secured to the keel 14 at the eyelet 28. The other end of the stabilizer line 30 is secured to the leading edge 24 of the wing portion 20 at a line connect location 34. One end of the stabilizer line 32 is secured to the keel 14 at the eyelet 28, and the other end is secured to the leading edge 22 of the wind portion 18 at a line connect location 36.

The stabilizer lines 30 and 32 are each substantially of the same length, and establish the maximum separation between the angular corner 26 of the keel 14 and the line connect locations 34 and 36. The dimensions of the stabilizer lines 30 and 32 of the keel 14 are such that when the keel 14 is substantially perpendicular with respect to the body 12, the lines 30 and 32 are taut.

Figure 2:
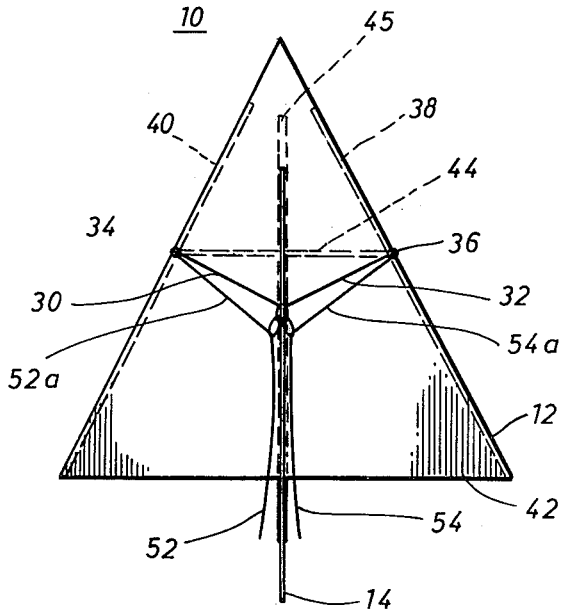
FIG. 2 is a planar view of the kite and the control apparatus illustrated in FIG. 1.

The keel guided kite 10 includes rigidifying structural members illustrated in phantom in FIG. 2. The structural members include two side supports 38 and 40. The body 12 of the kite 10, which comprises a sheet of thin flexible material 42, is secured at opposite edges to the side supports 38 and 40. A cross brace 44 is rigidly connected to the side supports 38 and 40. Also included is a center support 45 disposed substantially along the longitudinal axis or center line of the kite 10. The center support 45 is secured to the flexible material 42 of the body 12.

All of the rigidifying structural members are disposed on one face of the flexible material 42, and the keel 14 is disposed on the opposite face. The keel 14, which is also formed of a thin flexible material, is attached along its longest edge, the edge 16, to the flexible material 42 along the center line or longitudinal axis of the body 12. The keel 14 is also attached to the center support 45 at one or more points along the portion of the center support 45 that extends beyond the body 12 of the kite 10.

Referring to the figures, and in particular to FIG. 3, a line 46 is connected to the eyelet 28 of the keel 14. Rings 48 and 50 are attached by the line 46 to the angular corner 26 of the keel 14 at the eyelet 28.

A control line 52 passes through the ring 48 and is secured to the leading edge 24 of the wing portion 20 at the line connect location 34. A control line 54 passes through the ring 50 and is secured to the leading edge 22 of the wing portion 18 at the line connect location 36. The control lines 52 and 54 extend downward to the kite operator located on the ground.

The control lines 52, 54 are slidingly engaged by the rings 48, 50. As one of the control lines 52, 54 is pulled by the operator located on the ground, the respective ring 48, 50 is caused to move closer to its respective line connect location 34, 36 thereby causing the angular corner 26 of the keel 14 to be brought closer to that line connect location. This reduces the separation between the angular corner 26 and the line connect location at which the actuated control line is secured, to below the maximum separation established by the respective stabilizer line.

In operation, the keel guided kite 10 is airborne with the keel 14 disposed substantially perpendicular to the body 12. The stabilizer lines 30 and 32 are taut. A control line section **52*a* disposed between the ring 48 and the line connect location 34, and a control line section 54*a* disposed between the ring 50 and the line connect location 36** are also taut.

The operator located on the ground then pulls the control line 52. The length of the control line section **52*a* is reduced. The ring 48 is drawn closer to the line connect location 34. The separation between the angular corner 26 and the line connect location 34 is decreased. The stabilizer line 30 slackens, and the keel 14 forms a concave pocket whose opening faces the wing portion 20. The aerodynamics properties of the keel 14 are changed, and the kite 10** rolls in the direction of the newly formed pocket.

To cause the keel 14 to form a concave pocket whose opening faces the wing portion 18, the operator pulls the control line 54. The control line section **54*a* shortens; the stabilizer line 32 slackens; the stabilizer line 30 remains taut; and the angular corner 26 is drawn closer to the line connect location 36**.

By manipulating the control lines 52 and 54, the operator selectively varies the size and orientation of the pocket formed by the keel 14, thereby selectably changing the aerodynamic characteristics of the keel, causing the kite to change directions. The present kite and control apparatus allows the operator to readily control the maneuvering of the kite from the ground by manipulating the control lines 52 and 54.

In the illustrated embodiment of the present invention, the line connect locations 34 and 36 are disposed at the leading edges 24 and 22 of the wing portions 20 and 18, respectively, approximately at the locations at which the cross brace 44 is connected to the side supports 40 and 38. The flying characteristics of the kite 10 can be changed by changing the location of the line connect locations 34 and 36. The line connect location 34 can be disposed at any desirous position on the wing portion 20, and the line connect location 36 can be disposed at any desirous location on the wind portion 18. It is advantageous, however, to position the line connect locations 34 and 36 along the side supports 40 and 38, respectively, and most advantageous to position the line connect locations as illustrated.

The stabilizer lines 30 and 32 of the illustrated embodiment pass through eyelets included in the body 12 at the line connect locations 34 and 36, respectively. The stabilizer lines 30 and 32 are tied about and secured to the side supports 40 and 38. As will be apparent to those skilled in the art, the stabilizer lines 30 and 32 may be secured at the line connect locations 34 and 36 in any suitable manner, and using any suitable structure. Similarly, the stabilizer lines 30 and 32 can be secured at the angular corner 26 of the keel 14 in any suitable manner and using any suitable structure.

The control lines 52 and 54 are guided by the rings 48 and 50 and the line 46. As will be apparent to those skilled in the art, any suitable control line guidance structure may be used which permits the control line sections **52*a* and 54*a* to be selectively varied in length. In an alternate embodiment (not illustrated) the line 46 and the rings 48 and 50 are eliminated, and the control lines 52 and 54 pass through the eyelet 28**.

It will be apparent to those skilled in the art that the control apparatus of the present invention can be used on known prior art keel kites. To add the control apparatus illustrated in FIG. 3 to a prior art keel kite, all that need be done is secured one end of the stabilizer lines 30 and 32 to the eyelet 28 at the angular corner 26 of the keel 14, and secure the other end of the stabilizer lines 30 and 32 to the line connect locations 34 and 36. The rings 48 and 50 are then secured to the eyelet 28 by the line 46. One end of the control line 52 is passed through the ring 48 and is then secured at the line connect location 34. One end of the control line 54 is passed through the ring 50 and secured at the line connect location 36.

In an alternate embodiment (not illustrated), the stabilizer lines 30 and 32 are secured to the line connect locations 34 and 36, and the control lines 52 and 54 are secured to line connect locations between **34*a* and 36*a*. In this embodiment, the line connect locations 34*a* and 36*a* are spaced from the line connect locations 34 and 36**, respectively.

The principles, preferred embodiments and modes of operation of the present invention have been described in the foregoing specification. The invention is not to be construed as limited to the particular forms disclosed, since these are regarded as illustrative rather than restrictive. Moreover, variations and changes may be made by those skilled in the art without departing from the spirit of the invention.

What is claimed is:

1. A keel guided kite comprising:

a body;

a keel having a generally triangular configuration and including:

an edge secured to said body and extending generally fore and aft of said body, dividing said body into first and second wing portions, each of said wing portions having a reference location; and an angular corner disposed opposite said edge;

a first stabilizer secured to said keel and to said first wing portion to establish a first maximum separation between said angular corner and said reference location of said first wing portion;

a second stabilizer secured to said keel and to said second wing portion to establish a second maximum separation between said angular corner and said reference location of said second wing portion; and control means for reducing the separation between said angular corner and the reference location of at least one of said first and second wing portions to less than said first and second maximum separations.

2. The keel guided kite according to claim 1 wherein said control means is adapted to receive first and second control lines and comprises:

control line guidance structure secured to said keel at said angular corner to receive said first and second control lines;

first securing structure included at said reference location of said first wing portion to receive and secure an end of said first control line; and second securing structure included at said reference location of said second wing portion to receive and secure an end of said second control line.

3. The keel guided kite according to claim 2 wherein:

each of said wing portions includes a leading edge and said reference location is disposed at said leading edge; and said first and second stabilizers are secured to said first and second wing portions at said reference locations.

4. A keel guided kite adapted to receive first and second control lines, said kite comprising:

a body;

a keel secured to said body and extending generally fore and aft of said body, dividing said body into first and second wing portions;

a first stabilizer line having an end secured to said keel and another end secured to said first wing portion;

a second stabilizer line having an end secured to said keel and another end secured to said second wing portion; and control line guidance structure connected to said keel to receive said first and second control lines;

wherein said body includes said first and second securing structures to receive and secure an end of said first and second control lines to said first and second wing portions, respectively.

5. The keel guided kite according to claim 4 wherein said first and second wing portions have first and second leading edges, respectively, and further wherein said first and second stabilizer lines are secured to said first and second leading edges, respectively.

6. The keel guided kite according to claim 4 wherein said first and second wing portions have first and second leading edges, respectively, and further wherein said first and second securing structures are disposed at said first and second leading edges, respectively.

7. The keel guided kite according to claim 4 wherein said first and second stabilizer lines are secured to said first and second securing structures, respectively.

8. The keel guided kite according to claim 4 wherein said control line guidance structure includes a first structure to receive and guide said first control line, and a second structure to receive and guide said second control line.

9. The keel guided kite according to claim 8 wherein said first and second structures each comprise a ring member.

10. A keel guided kite adapted to receive first and second control lines, said kite comprising:

a body;

a keel of flexible material secured to said body and extending generally fore and aft of said body, dividing said body into two wing portions;

two stabilizer lines, each of said lines having an end secured to said keel, and another end secured to one of said wing portions;

structure included on said keel to receive said first and second control lines; and structure included on each of said wing portions to receive and secure one of said first and second control lines.

11. A keel guided kite adapted to receive first and second control lines, said kite comprising:

a body having a sheet of flexible material secured to structural means for supporting said sheet in an extended flying position;

a keel of flexible material disposed on the opposite side of said sheet from said structural means and secured to said body and extending generally fore and aft of said body dividing said body into two wing portions, each of said wing portions having a leading edge;

a first stabilizer line having a first end secured to the leading edge of one of said wing portions at a first wing connect location, and having a second end secured to the keel at a first keel connect location;

a second stabilizer line having a first end secured to the leading edge of the other of said wing portions at a second wing connect location, and having a second end secured to the keel at said first keel connect location;

first securing structure included at said first wing connect location to receive and secure an end of said first control lines;

second securing structure included at said second wing connect location to receive and secure an end of said second control lines; and control line guidance structure included at said first keel connect location to receive said first and second control lines.

12. A keel guided kite comprising:

a body;

a keel secured to said body and extending generally fore and aft of said body, dividing said body into two portions each having a line connect location;

two stabilizer lines, each of said stabilizer lines having an end secured to said keel and another end secured to one of said wing portions at said line connect location; and two control lines, each of said control lines having an end secured to one of said wing portions at said line connect location;

wherein said keel includes control line guidance structure to receive said control lines.

13. The keel guided kite according to claim 12 wherein said control line guidance structure includes two ring members, each of said ring members receiving one of said control lines.

14. Kite control apparatus for a keel guided kite having a body and a keel secured to said body and extending generally fore and aft of said body dividing said body into two wing portions, said kite control apparatus comprising:

two stabilizer lines, each of said stabilizer lines having an end adapted to be secured to said keel and another end adapted to be secured to one of said wing portions;

control line guidance structure adapted to be secured to said keel; and two control lines, each of said control lines being received by said control line guidance structure and having an end adapted to be secured to one of said wing portions.

* * * * *

UNITED STATES PATENT AND TRADEMARK OFFICE

CERTIFICATE OF CORRECTION

PATENT NO. : 4,457,478

DATED : July 3, 1984

INVENTOR(S) : Julius M. Christoffel, Jr.; George Peneer

It is certified that error appears in the above-identified patent and that said Letters Patent is hereby corrected as shown below:

Column 2, line 62, delete "wind" and insert --wing--.

line 68, insert --and-- after "32" and before "of".

Column 4, line 19, delete "wind" and insert --wing--.

line 47, delete "secured" and insert --secure--.

Signed and Sealed this

*Twenty-seventh* Day of *November 1984*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,457,478

DATED : July 3, 1984

INVENTOR(S) : Julius M. Christoffel, Jr.; George Reneer

It is certified that error appears in the above-identified patent and that said Letters Patent is hereby corrected as shown below:

The second inventor's name was misspelled.

Title page, delete "George Peneer" and insert --George Reneer--.

Signed and Sealed this

*Fifth* Day of *March 1985*

[SEAL]

*Attest:*

DONALD J. QUIGG

*Attesting Officer* *Acting Commissioner of Patents and Trademarks*